United States Patent [19]

Roper

[11] Patent Number: 4,536,931

[45] Date of Patent: Aug. 27, 1985

[54] BEARING BURNISHING METHOD AND APPARATUS

[75] Inventor: Ralph E. Roper, Indianapolis, Ind.

[73] Assignee: Wallace Expanding Machines, Inc., Indianapolis, Ind.

[21] Appl. No.: 362,268

[22] Filed: Mar. 26, 1982

[51] Int. Cl.[3] ..... B24B 39/00

[52] U.S. Cl. ..... 29/90 R; 72/74; 74/109

[58] Field of Search ..... 29/90 R, 90 B, 91; 72/74, 112, 115; 74/109

[56] References Cited

U.S. PATENT DOCUMENTS

| | | | |
|---|---|---|---|
| 231,876 | 8/1880 | White | 29/90 R |
| 577,973 | 3/1897 | Whittemore | 29/90 R |
| 2,432,020 | 12/1947 | Laesser | 74/109 |
| 2,791,024 | 5/1957 | Vavrinek | 29/90 R |
| 4,198,736 | 4/1980 | Eberle | 29/90 R |

FOREIGN PATENT DOCUMENTS

| | | | |
|---|---|---|---|
| 1283070 | 11/1968 | Fed. Rep. of Germany | 74/109 |
| 2068277 | 8/1981 | United Kingdom | 72/112 |
| 706168 | 1/1980 | U.S.S.R. | 29/90 B |
| 831582 | 5/1981 | U.S.S.R. | 29/90 R |

*Primary Examiner*—Leonidas Vlachos
*Assistant Examiner*—Jerry Kearns
*Attorney, Agent, or Firm*—Woodard, Weikart, Emhardt & Naughton

[57] ABSTRACT

An apparatus and a process for burnishing annular surfaces. The apparatus includes a burnishing tool which is actuated to rotate in one direction and then in the opposite direction. The apparatus is used for the burnishing of annular thrust bearings which have oil wick slots and wick slot oil ramps. A rack and pinion connects a tool mounting spindle to an air cylinder and is used to rotate the tool in one direction and then the other direction. The tool has a convexly shaped burnishing surface. The tool's axis of rotation is coaxially aligned with the central axis of the annular surface. The rotation of the tool in one direction and then in the other direction burnishes the thrust surface and the wick slot oil ramps of the bearings. The opposite ends of the rotational burnishing strokes locates the tool in the wick slots so as to leave no stopping imperfection on the thrust surface of the bearing.

8 Claims, 9 Drawing Figures

BEARING BURNISHING METHOD AND APPARATUS

BACKGROUND OF THE INVENTION

1. Field of the Invention

This invention relates in general to a process and an apparatus for burnishing a workpiece and, more particularly, to a process and apparatus adapted for burnishing the annular thrust surface and wick slot oil ramps of a thrust bearing.

2. Description of the Prior Art

Numerous devices have been developed for burnishing workpieces. Burnishing as used herein means the requalifying of the surface material of the workpiece so that it is flat, extremely smooth, and compacted. The prior art devices typically achieve burnishing by moving a burnishing tool against the workpiece surface in one relative direction. Usually this is accomplished by a rotary action in one direction. However, there are problems with this type of rotary action on an annular surface in that it is difficult to keep the surface clean and to keep the tool from picking up material and scoring the surface because the tool continues to accumulate material as it rotates. In the case of burnishing annular powdered metal surfaces, keeping the surface and the tool clean during single direction rotation can be extremely difficult. Unlike the prior art, the present invention provides for rotary burnishing of annular surfaces in one direction and then in the opposite direction so that material does not accumulate and the surface and tool are kept clean to provide better and more efficient burnishing.

Numerous devices can also be used to burnish the thrust surface of thrust bearings. However, many thrust bearings as is well known in the art have oil wick slots. These slots hold a porous oil soaked wick which provides oil to the thrust surface of the bearing. These oil wick slots have chamfered oil ramps as is well known in the art which lead oil from the edge of the oil wick slots onto the thrust surface. None of the prior art devices provide for a single process and apparatus for burnishing these oil ramps and the annular thrust surface so that these surfaces become flat, extremely smooth, and compressed for better oil flow.

Other examples of possible prior art devices and processes are shown in the following patents:

Timken: U.S. Pat. No. 1,441,893
Maupin: U.S. Pat. No. 1,619,479
Langhammer: U.S. Pat. No. 1,944,246
Chambers: U.S. Pat. No. 3,059,315
Heim: U.S. Pat. No. 3,093,884
Estry: U.S. Pat. No. 3,281,919
Williams: U.S. Pat. No. 3,307,254
Kalen: U.S. Pat. No. 3,795,956
Benson: U.S. Pat. No. 3,818,559

The Timken patent discloses a method and an apparatus for burnishing the cones of roller bearings with rollers. The Maupin patent discloses a method and an apparatus for burnishing cylindrical bearing surfaces. The Langhammer patent discloses an apparatus for sizing journal bushing. The Chambers patent discloses a burnishing tool for the burnishing of the radial fillet of a counterbore. The Heim patent discloses an apparatus for burnishing telescoped bearings. The Estry patent discloses a diamond burnishing apparatus where the tool is pivotally mounted on a lever for the purpose of burnishing crankshafts and the like. The Williams patent discloses a burnishing tool head for simultaneous cutting and burnishing of a surface. The Kalen patent discloses a burnishing tool for arcuate surfaces. The Benson patent discloses a burnishing tool for burnishing the interior wall of a hollow cylindrical surface.

These patents show various burnishing devices but do not show a process or device for the burnishing of an annular thrust surface of a thrust bearing. Further, none disclose the concurrent burnishing of chamfered wick slot oil ramps. These devices disclose rotary motion in only one relative direction.

SUMMARY OF THE INVENTION

A burnishing process and apparatus are disclosed herein for the burnishing of an annular surface of a workpiece. The process and the apparatus comprise the use of a burnishing tool and a rotating means for creating a relative rotational movement between the burnishing tool and the surface of the workpiece. The rotating means causes the relative rotational movement to be in one direction and then in the opposite direction.

It is therefore an object of this invention to provide an improved process and an apparatus for the burnishing of surfaces.

It is further an object of this invention to provide an improved process and apparatus for the burnishing of annular thrust surfaces of thrust bearings.

It is further an object of this invention to provide an improved process and apparatus for burnishing the annular thrust surface and the wick slot oil ramps of a thrust bearing.

It is another object of this invention to provide a process and an apparatus for burnishing the annular thrust surface and wick slot oil ramps of a thrust bearing in a manner that the burnishing tool does not leave imperfections on the thrust surface where the tool stops.

Related objects and advantages will become apparent as the description proceeds.

DESCRIPTION OF THE PREFERRED EMBODIMENT

Figure 1:
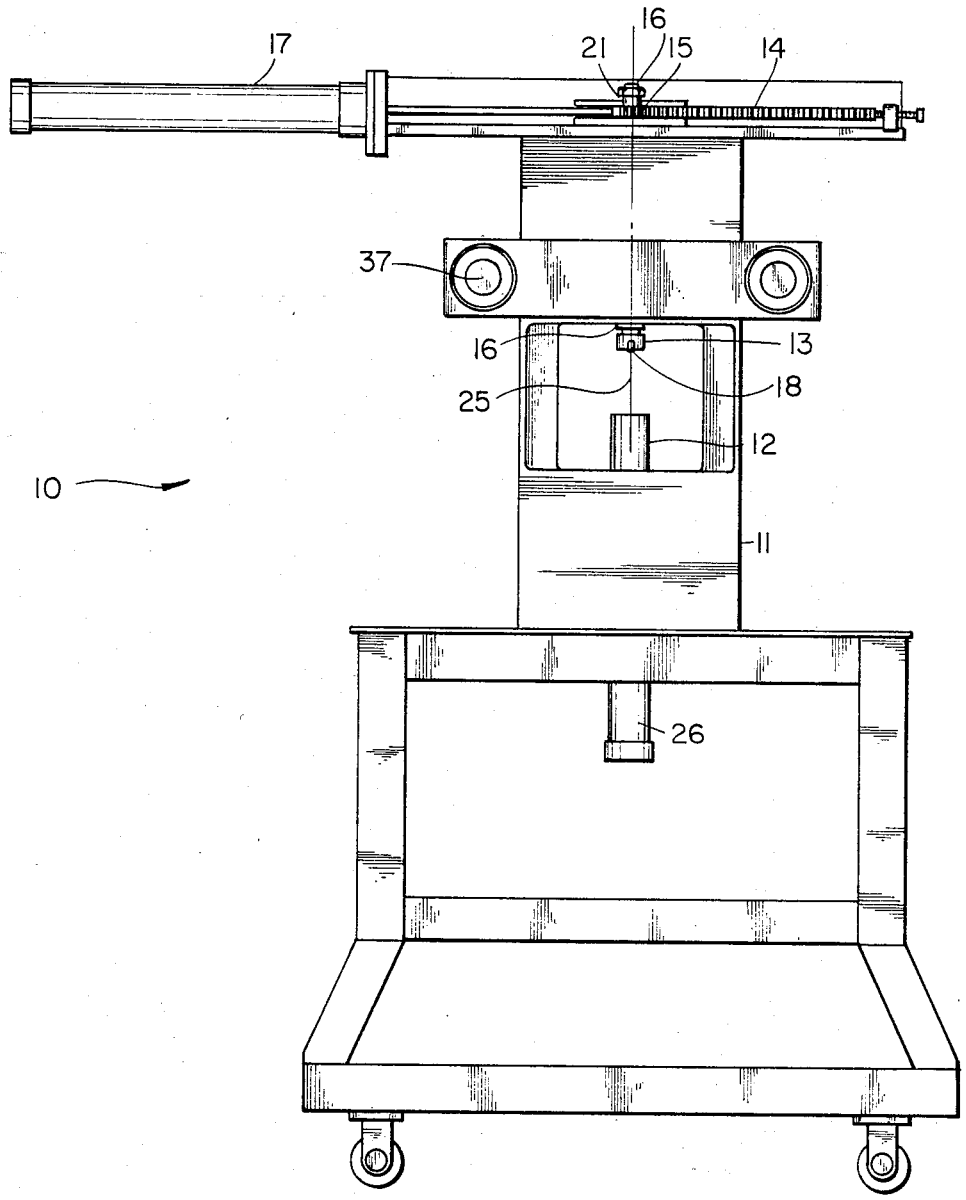
FIG. 1 is a front, elevational view of a preferred embodiment of a burnishing apparatus constructed in accordance with the present invention and particularly showing a rack and pinion which forms a part of the apparatus.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
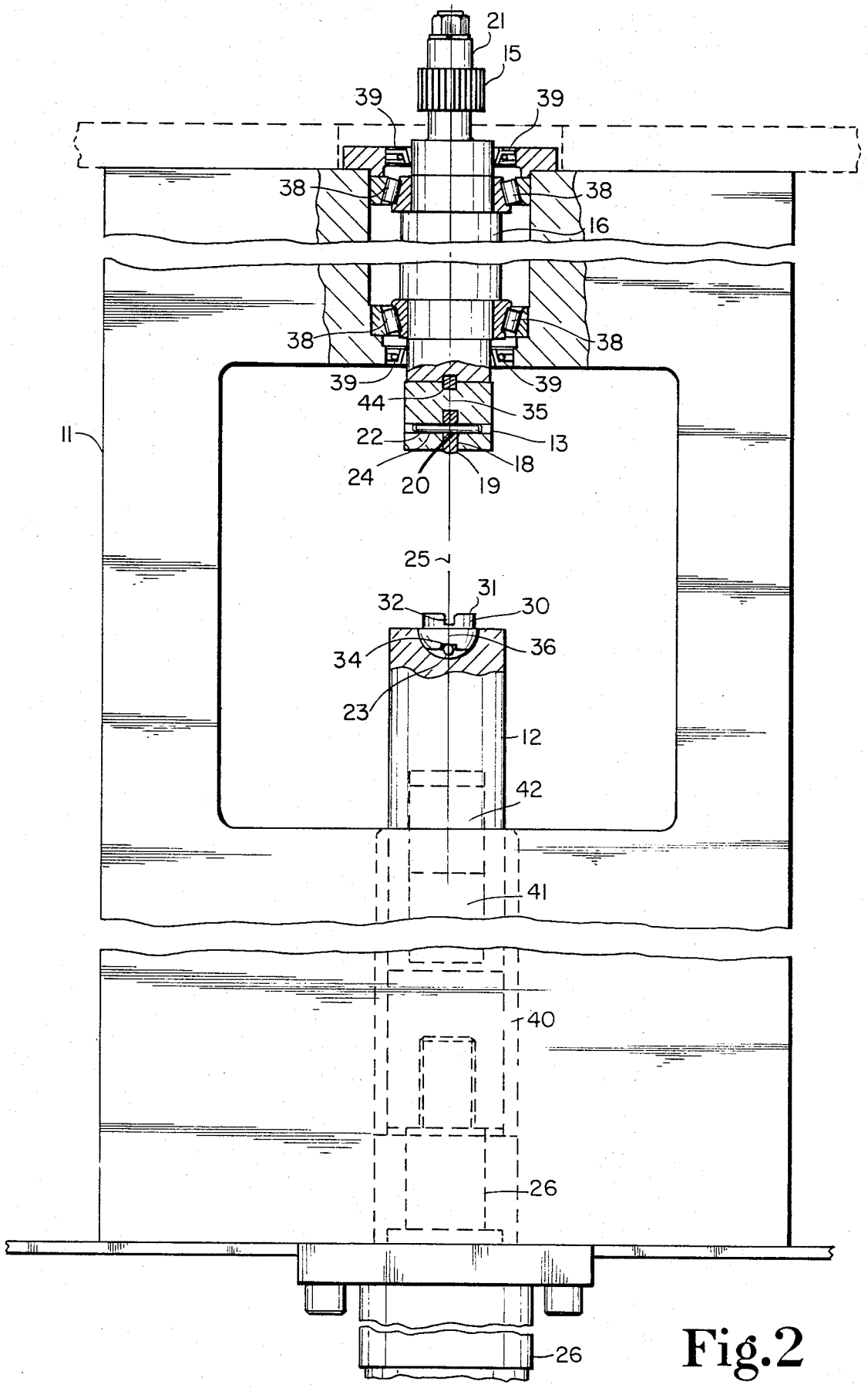
FIG. 2 is a front elevational view of the apparatus of FIG. 1 and in partial cross section showing the rack and pinion connected to a spindle which holds and rotates a burnishing tool.

Referring to FIG. 1, there is illustrated a bearing burnishing apparatus 10 including a housing 11. Mounted on the housing is a rack 14 in driving engagement with a pinion 15. The pinion 15 is drivingly mounted at the gear assembly end 21 to the spindle 16 which is rotatably mounted in the housing 11 (FIG. 2). The rack 14 is secured to and driven by a rack actuating air cylinder 17 which is mounted to the housing 11. In the preferred embodiment the rack is actuated by an air cylinder but it could be driven by other suitable means known in the art. The rack 14 is actuated by the rack actuating air cylinder 17 to move through a stroke and return to where it started. The gear mesh of the rack 14 with the pinion 15 is preferably set up so that the rack strokes back and forth causing the pinion 15 to rotate in one direction and then in the other direction so that both the rack and the pinion end up where they started after each stroke at each end of the stroke. Suitable control means 37 mounted on the housing 11, as are known in the art, control the rack actuating air cylinder 17 and the burnishing pressure air cylinder 26 which is also mounted on the housing 11.

FIG. 2 shows the spindle 16 rotatably mounted in the housing 11 by tapered roller bearings 38 in a manner known in the art. Oil seals 39 for the roller bearings also are included for lubrication as is known in the art. FIG. 2 further shows the burnishing tool 18 mounted on the tool holder 13 which is cross keyed mounted 44 to the spindle 16. The burnishing tool 18 preferably is a bar which is held in place in the tool holder 13 by a tool pin 22 which fits in a tool pin channel 20 in the burnishing tool 18 and in a tool holder pin channel 24 in the tool holder 13. Preferably, the burnishing tool 18 is mounted in the tool holder 13 so that only 0.001 inch of the convexly shaped burnishing surface 19 of the burnishing tool 18 projects from the tool holder 13.

The thrust bearing 30 (work piece) is held immovably in the bearing holder means 12 by a bearing holder dowel 23 which keys in with the bearing detents 34 on the underside of the thrust bearing 30. The bearing holder means 12 is in a guide means 40 in the housing 11 where it can slide up or down and is restrained by the action of a vertically elongated recess 41 in the bearing holder means 12 and a bar 42 fixed to the housing. The ends of the recess 41 engage the bar 42 to limit the stroke of the bearing holder means 12.

The burnishing pressure air cylinder 26 is secured to the bearing holder means 12 for the purpose of forcing the bearing holder means 12 upwardly in the guide means 40 so that the thrust bearing 30 will engage the burnishing surface 19 of the burnishing tool 18 in constant pressured contact. The burnishing tool 18 mounted in the tool holder 13 and the thrust bearing 30 held in the bearing holder means 12 are coaxially aligned about an axis of rotation 25. The axis of rotation 25 is the axis about which the spindle 16 rotates the burnishing tool 18 and the axis of rotation 25 is also coaxial with the central axis of the annular thrust surface 31 of the thrust bearing 30 when it is immovably held in the bearing holder means 12.

Figure 3A:
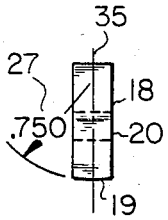
FIG. 3*a* is a frontal view of the carbide burnishing tool.
Figure 3B:
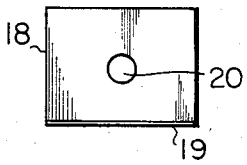
FIG. 3*b* is a side view of the carbide burnishing tool.
Figure 3C:
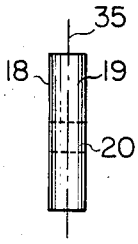
FIG. 3*c* is a bottom plan view of the tool.
Figure 4:
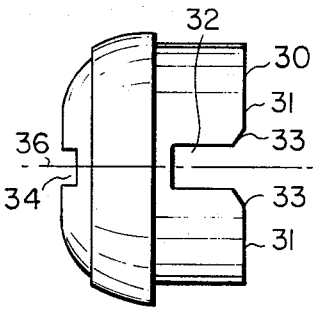
FIG. 4 is a side view of a thrust bearing particularly adapted for burnishing with the present invention.

FIG. 3*a* is a frontal view of the burnishing tool 18 and FIG. 3*b* is a side view of the burnishing tool 18. The burnishing tool 18 has a convexly shaped burnishing surface 19 which can have any radius 27 so long as the surface 19 is convex. A preferable radius 27 is about 0.750 inches. The burnishing tool 18 used in the preferred embodiment is made of carbide. Carbide has an extremely hard surface and requires no lubrication for the prevention of galling. However, the burnishing tool 18 could be made of other suitable materials known in the art such as commercial diamond, special heat treated tool steels, etc. FIG. 4 shows the thrust bearing 30 (work piece) which is of a type known in the art. The thrust bearing 30 has an annular thrust surface 31 and oil wick slots 32. These oil wick slots 32 have chamfered wick slot oil ramps 33 on both sides of the oil wick slots 32 leading onto the annular thrust surface 31 as is known in the art.

Figure 5:
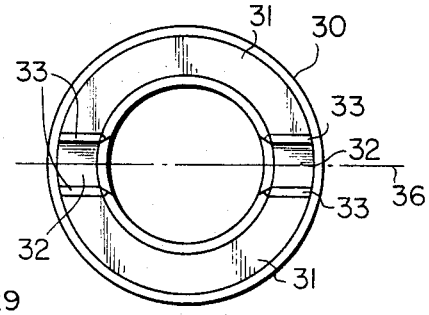
FIG. 5 is a top view of the thrust bearing of FIG. 5.

As is known in the art, during use of this type of thrust bearing 30 an oil soaked wick is in the oil wick slots 32. The oil from the wick flows onto the wick slot oil ramps 33. These wick slot oil ramps 33 lead the oil onto the annular thrust surface 31. In powdered metal bearings it is important that the annular thrust surface 31 and the wick slot oil ramps 33 both be burnished so that the metal surface will be compressed and less porous so that oil will not be absorbed by the thrust bearing 30 on the wick slot oil ramps 33 or the annular thrust surface 31. This provides better lubrication and operation of the thrust bearing 30. The top view in FIG. 5 shows the thrust bearing 30 and the annular thrust surface 31. The oil wick slots 32 and the chamfered wick slot oil ramps 33 are shown on both sides of each oil wick slots 32.

Figure 6:
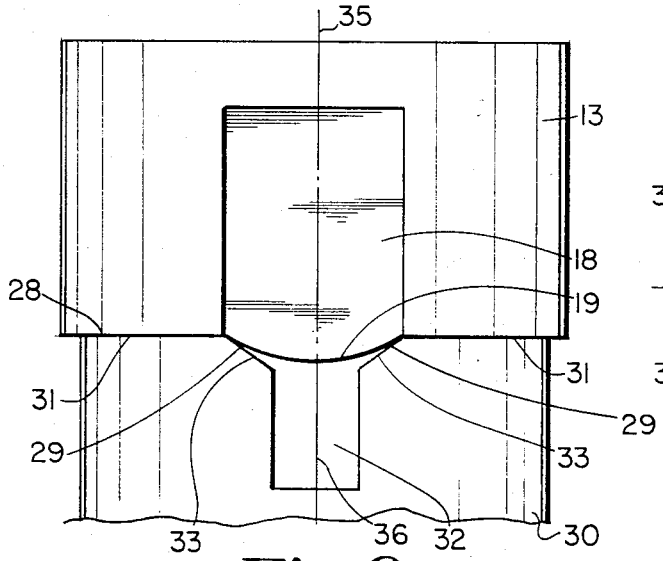
FIG. 6 is a frontal view of the burnishing tool in its initial orientation relative to the wick slot of a thrust bearing to be burnished.

FIG. 6 shows how the burnishing tool 18 and the thrust bearing 30 are preferably initially aligned with their respective center planes 35 and 36 coextensive. The burnishing tool 18 radiused burnishing surface 19 drops into the oil wick slots 32 and engages with the wick slot oil ramps 33. This engagement is in presssured contact caused by a burnishing pressure air cylinder 26 which forces the bearing holder means 12 against the burnishing tool 18. The tool holder 13 engages the thrust surface 31 at 28 so that the burnishing tool 18 drops into the slots only 0.001 of an inch which is the amount that the burnishing tool 18 preferably projects out of the tool holder 13. Preferably, the burnishing tool 18 is slightly wider than the oil wick slots 32 but the convexly radiused burnishing surface 19 allows part of the surface 19 to drop into the slot 32, thus the burnishing surface 19 engages the wick slot oil ramps 33 at 29.

Figure 7:
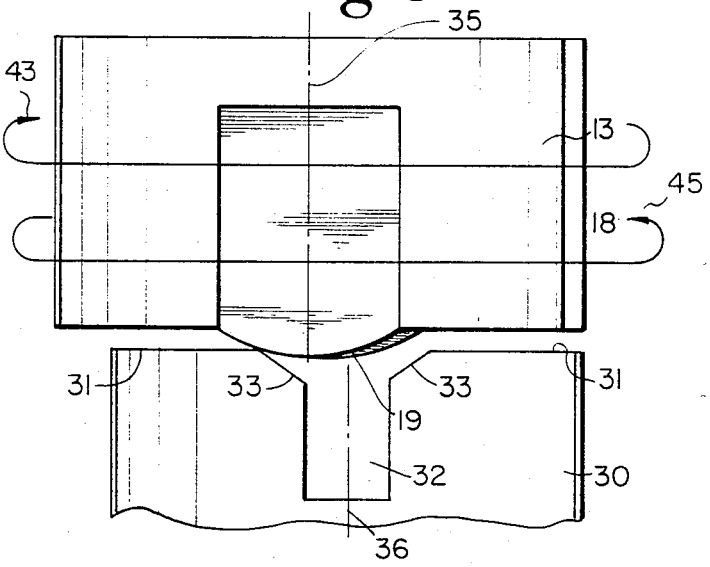
FIG. 7 is a frontal view of the burnishing tool as it burnishes one of the wick slot oil ramps as the tool rotates and rides up out of the slot and onto the thrust surface.

FIG. 7 shows how, as the burnishing tool 18 is rotated, (in the direction of the arrow 43), the burnishing surface 19 rides up out of the slot 32 and burnishes the wick slot oil ramps 33 and then moves onto the annular thrust surface 31 to burnish it. Preferably the tool rotates four 360° revolutions in the direction of arrow 43. Then the burnishing tool 18 is rotated an equal amount in the other direction (arrow 45) so that the opposite wick slot oil ramp 33 is also properly burnished. The air cylinder 26 pressure allows for the maintaining of a constant pressure between surface 31 and burnishing tool 18 even though there is a slight difference in height between where the burnishing tool 18 is in the oil wick slots 32 or on the thrust surface 31.

Using suitable controls 37 as are known in the art to control the air cylinders 17 and 26 the apparatus process is as follows:

The thrust bearing 30 is immovably held in the bearing holder means 12 by the bearing holder dowel 23 so that the thrust surface 31 is coaxially aligned about the axis of rotation 25 which is the axis about which the burnishing tool 18 rotates. The burnishing tool 18 and thrust bearing 30 are preferably aligned so that the tool center plane 35 is coextensive with the wick slot center plane 36 as shown in FIG. 6. The air cylinder 26 then provides pressure which raises the bearing holder means 12 in the guide 40 so that the thrust bearing 30 contacts the burnishing tool 18 in constant pressured contact. In this position (FIG. 6) the convex burnishing surface 19 of the burnishing tool 18 does not engage the thrust surface 31 but is dropped into the slots 32 and engages the wick slot oil ramps 33.

The air cylinder 17 then reciprocates the rack 14 so that the rack 14 actuates the pinion 15 to rotate in one direction a number of revolutions and then to rotate in the opposite direction the same number of revolutions. The number of teeth in the rack 14 and the number of teeth in the pinion 15 and the length of the rack stroke by the air cylinder 17 is predetermined so that the pinion 15 will stop at each end of the rack stroke in the same orientation. The rotations of the pinion 15 are transferred through the spindle 16 and thus the burnishing tool 18 is similarly rotated so that the tool 18 always stops at both ends of the rack stroke in the orientation of FIG. 6.

As the tool starts its rotation and as it turns in one direction, the surface 19 rides up out of the oil wick slots 32 and thereby properly burnishes two of the four wick slot oil ramps 33 and then the thrust surface 31. When the burnishing tool 18 rotates in the opposite direction the convex burnishing surface 19 comes back around and properly burnishes the other two of the four wick slot oil ramps 33. When the rotations are completed at the end of each stoke, the burnishing tool 18 stops in the initial alignment of FIG. 6. This means that the burnishing tool 18 always stops in the oil wick slots 32 and never on the thrust surface 31. Consequently, the burnishing tool 18 does not leave an undesirable imperfection on the annular thrust surface 31 by stopping thereon. The entire process is accomplished while the burnishing tool 18 is pressed against the thrust bearing 30 with a maintained measured pressure. The machine is presently being used on powdered metal bearings and it has been found that a rack and pinion with a gear ratio causing four 360° revolutions in the first direction and then four 360° revolutions in the opposite direction in a speed range of between 100 to 150 rpms with a 120 lb. pressure between the burnishing tool 18 and thrust bearing 30 will achieve good results.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A burnishing apparatus for the burnishing of an annular thrust surface and wick slot oil ramps of a thrust bearing which has wick slots in the thrust surface, said apparatus comprising:

bearing holder means having means for immovably holding and orienting the thrust bearing, the thrust bearing having a first axis perpendicular to the annular thrust surface and positioned at the geometric center of the annular thrust surface;

a rotatable spindle which has a central axis and a tool assembly end and a gear assembly end;

first positioning means, on said bearing holder means, for positioning the thrust bearing so that the central axis is coaxial with the first axis;

a burnishing tool including an elongated bar which has a transverse convexly shaped burnishing surface and a tool mounting end, the tool mounting end being mounted to the tool assembly end of said spindle so that the burnishing surface rotates about the first axis;

second positioning means for positioning said burnishing tool with respect to said orienting means so that the burnishing surface and the wick slots of the thrust surface are in an initial alignment;

pressure means connected to said bearing holder means for maintaining the burnishing surface and the thrust surface in pressured contact;

rotating means for rotating said spindle, said rotating means including a rack and pinion, and the gear assembly end of said spindle being connected to the pinion said rotatinq means further including means connected to said rack for moving the rack and pinion to cause said spindle to rotate in a first direction about the first axis and then in a second opposite direction about the first axis;

first stopping means for stopping the rotation of said spindle at the end of movement in the first direction, said first stopping means being adjusted so that the burnishing surface and the wick slots of the thrust surface are in alignment at each such stopping; and second stopping means for stopping the rotation of said spindle at the end of movement in the second direction, said second stopping means being adjusted so that the burnishing surface and the wick slots of the thrust surface are in alignment at each such stopping.

2. A burnishing apparatus for the burnishing of an annular thrust surface and wick slot oil ramps of a thrust bearing which has wick slots in the thrust surface, said apparatus comprising:

bearing holder means having means for immovably holding and orienting the thrust bearing, the thrust bearing having a first axis perpendicular to the annular thrust surface and positioned at the geometric center of the annular thrust surface;

a rotatable spindle which has a central axis and a tool assembly end and a qear assembly end;

first positioning means, on said bearing holder means, for positioning the thrust bearing so that the central axis is coaxial with the first axis;

a burnishing tool including an elongated bar which has a transverse convexly shaped burnishing surface and a tool mounting end, the tool mounting end being mounted to the tool assembly end of said spindle so that the burnishing surface rotates about the central axis;

second positioning means for positioning said burnishing tool with respect to said orienting means so that the burnishing surface and the wick slots of the thrust surface are in an initial alignment;

pressure means connected to said bearing holder means for maintaining the burnishing surface and the thrust surface in pressured contact;

rotating means connected to said spindle for rotating said spindle, said rotating means further including means for causing said spindle to rotate in a first direction about the central axis and then in a second opposite direction about the central axis;

first stopping means for stopping the rotation of said spindle at the end of movement in the first direction, said first stopping means being adjusted so that the burnishing surface and the wick slots of the thrust surface are in alignment at each such stopping; and second stopping means for stopping the rotation of said spindle at the end of movement in the second direction, said second stopping means being adjusted so that the burnishing surface and the wick slots of the thrust surface are in alignment at each such stopping.

3. The burnishing apparatus of claim 2, wherein said rotating means includes a rack and pinion, the pinion being connected to the gear assembly end of said spindle.

4. The burnishing apparatus of claim 1, wherein said stopping means includes the rack and pinion of said rotating means, the number of teeth in the rack and the number of teeth in the pinion and the length of the rack being such that the pinion stops in the same orientation at the end of each rack stroke.

5. The burnishing apparatus of claim 1, wherein said pressure means includes an air pressured cylinder.

6. The burnishing apparatus of claim 4, wherein said rotating means includes an air pressured cylinder drivingly connected to the rack.

7. The burnishing apparatus of claim 6, wherein said pressure means includes an air pressured cylinder.

8. A process for burnishing an annular thrust surface and wick slot oil ramps of a thrust bearing which has wick slots in the thrust surface, comprising the steps of:

(1) providing a thrust having an annular thrust surface and wick slots in the thrust surface and wick slot oil ramps and having an axis perpendicular to said annular thrust surface;

(2) providing a rotatable spindle having a central axis and a tool assembly end;

(3) providing a burnishing tool, including an elongated bar having a transverse convexly shaped burnishing surface, attached to said tool assembly end such that the burnishing surface rotates about the central axis;

(4) orienting said thrust bearing such that the axis of rotation of the burnishing tool is coaxial with the axis of the thrust bearing;

(5) supporting the burnishing tool and the thrust bearing for relative rotation;

(6) orienting the burnishing surface in an initial alignment with the wick slots of the thrust bearing;

(7) placing and maintaining the burnishing surface in pressured contact with the thrust bearing; and (8) rotating said spindle to produce relative rotational movement between the burnishing tool and the thrust bearing in a first direction, then in a second direction opposite to the first direction, the rotational movement starting and stopping only when the burnishing tool is aligned with the wick slots.

* * * * *

UNITED STATES PATENT AND TRADEMARK OFFICE

CERTIFICATE OF CORRECTION

PATENT NO. : 4,536,931

DATED : Aug. 27, 1985

INVENTOR(S) : Ralph E. Roper

It is certified that error appears in the above-identified patent and that said Letters Patent is hereby corrected as shown below:

Column 8, line 11 should read:

(1) providing a thrust <u>bearing</u> having an annular thrust surface

Signed and Sealed this

*Tenth* Day of *December 1985*

[SEAL]

*Attest:*

DONALD J. QUIGG

*Attesting Officer*

*Commissioner of Patents and Trademarks*